US006165703A

United States Patent [19]

Parton et al.

[11] Patent Number: 6,165,703

[45] **Date of Patent: *Dec. 26, 2000**

[54] COLOR PHOTOGRAPHIC MATERIAL HAVING ENHANCED LIGHT ABSORPTION

[75] Inventors: Richard L. Parton, Webster; Thomas L. Penner, Fairport; Andrei Andrievsky; William J. Harrison, both of Rochester, all of N.Y.

[73] Assignee: Eastman Kodak Company, Rochester, N.Y.

[ * ] Notice: This patent is subject to a terminal disclaimer.

[21] Appl. No.: 09/151,915

[22] Filed: Sep. 11, 1998

[51] Int. Cl.[7] ..... G03C 1/29; G03C 1/14

[52] U.S. Cl. ..... 430/572; 430/574; 430/583; 430/584; 430/585; 430/611; 430/631

[58] Field of Search ..... 430/572, 574, 430/583, 584, 585, 611, 546, 631

[56] References Cited

U.S. PATENT DOCUMENTS

| | | | |
|---|---|---|---|
| 2,518,731 | 8/1950 | Thompson . | |
| 3,622,316 | 11/1971 | Bird et al. . | |
| 3,976,493 | 8/1976 | Borror et al. . | |
| 3,976,640 | 8/1976 | Borror et al. . | |
| 4,040,825 | 8/1977 | Steiger et al. . | |
| 4,138,551 | 2/1979 | Steiger et al. . | |
| 4,820,606 | 4/1989 | Miyasaka et al. . | |
| 4,950,587 | 8/1990 | Roberts et al. . | |
| 5,491,052 | 2/1996 | Van Meter et al. | 430/545 |

FOREIGN PATENT DOCUMENTS

| | | |
|---|---|---|
| 270082 | 7/1992 | European Pat. Off. . |
| 0 545 453 A1 | 6/1993 | European Pat. Off. . |
| 565074 | 10/1993 | European Pat. Off. . |
| 270079 | 3/1994 | European Pat. Off. . |
| 838719 | 4/1998 | European Pat. Off. . |
| 64-91134 | 4/1989 | Japan . |
| 10171058 | 6/1998 | Japan . |

OTHER PUBLICATIONS

Lubert Stryer, Biochemistry (3rd Edition), 1975, 1981, 1988, pp. 7,8.

G. R. Bird, *Photogr. Sci. and Eng.,* vol. 18, No. 5, 1974, p. 52.

T. Forster, *Disc. Faraday Soc.,* vol. 27, 1959, p. 7.

R.Steiger and J. F. Reber, *Photogr. Sci. and Eng.,* vol. 27, 1983, p. 59.

T. L. Penner and P. B. Gilman, *Photogr. Sci. and Eng.,* vol. 20, 1976, p. 97.

T. L. Penner, *Photogr. Sci. and Eng.,* vol. 21, 1977, p. 32.

*Primary Examiner*—Thorl Chea

*Attorney, Agent, or Firm*—Edith A. Rice

[57] ABSTRACT

A silver halide color photographic material comprises at least one silver halide emulsion comprising silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one cyanine dye, Dye 2, wherein one of Dye 1 or Dye 2 has at least one anionic substituent and one of Dye 1 or Dye 2 has at least one cationic substituent and wherein the dye layers are held together by more than one non-covalent force; the outer dye layer adsorbs light at equal or higher energy than the inner dye layer; and the energy emission wavelength of the outer dye layer overlaps with the energy absorption wavelength of the inner dye layer.

In one embodiment the invention comprises a silver halide color photographic material comprising at least one silver halide emulsion comprising silver halide grains having associated therewith at least one dye which contains an anionic substituent and at least one dye that has a cationic substituent.

22 Claims, No Drawings

COLOR PHOTOGRAPHIC MATERIAL HAVING ENHANCED LIGHT ABSORPTION

FIELD OF THE INVENTION

This invention relates to a silver halide color photographic material containing at least one silver halide emulsion having enhanced light absorption.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to increased surface area. However, in most photographic systems, it is still the case that not all the available light is being collected.

Increasing the absorption cross-section of the emulsion grains should lead to an increased photographic sensitivity. The need is especially great in the green sensitization of the magenta layer of color negative photographic elements. The eye is most sensitive to the magenta image dye and this layer has the largest impact on color reproduction. Higher speed in this layer can be used to obtain improved color and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.,* 18, 562 (1974)). One method is to synthesize molecules in which two dye chromophores are covalently connected by a linking group (see U.S. Pat. No. 2,518,731, U.S. Pat. No. 3,976,493, U.S. Pat. No. 3,976,640, U.S. Pat. No. 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not connected to one another. In this approach the dyes can be added sequentially and are less likely to interfere with one another. Miysaka et al. in EP 270 079 and EP 270 082 describe silver halide photographic element having an emulsion spectrally sensitized with an adsorable sensitizing dye used in combination with a non-adsorable luminescent dye which is located in the gelatin phase of the element. Steiger et al. in U.S. Pat. No. 4,040,825 and U.S. Pat. No. 4,138,551 describe silver halide photographic element having an emulsion spectrally sensitized with an adsorable sensitizing dye used in combination with second dye which is bonded to gelatin. The problem with these approaches is that unless the dye not adsorbed to the grain is in close proximity to the dye adsorbed on the grain (less than 50 angstroms separation) efficient energy transfer will not occur (see T. Förster, *Disc. Faraday Soc.,* 27, 7 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.,* 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.,* 20, 97 (1976); see also Penner, *Photogr. Sci. Eng.,* 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. The problem with previous dye layering approaches was that the dye layers described produced a very broad sensitization envelope. This would lead to poor color reproduction since, for example, the silver halide grains in the same color record would be sensitive to both green and red light.

Yamashita et. al. (EP 838 719 A2) describes the use of two or more cyanine dyes to form dye layers on silver halide emulsions. The dyes are required to have at least one aromatic or heterocyclicaromatic substituent attached to the chromophore via the nitrogen atoms of the dye. This is undesirable because such substitutents can lead to large amounts of retained dye after processing (dye stain) which affords increased D-min. We have found that this is not necessary and that neither dye is required to have at least one aromatic or heterocyclicaromatic substitute attached to the chromophore via the nitrogen atoms of the dye. The dyes of our invention give increased photographic sensitivity.

PROBLEM TO BE SOLVED BY THE INVENTION

Not all the available light is being collected in many photographic systems. The need is especially great in the blue spectral region where a combination of low source intensity and relatively low dye extinction result in deficient photoresponse. The need for increased light absorption is also great in the green sensitization of the magenta layer of color negative photographic elements. The eye is most sensitive to the magenta image dye and this layer has the largest impact on color reproduction. Higher speed in this layer can be used to obtain improved color and image quality characteristics. The cyan layer could also benefit from increased red-light absorption which could allow the use of smaller emulsions with less radiation sensitivity and improved color and image quality characteristics. For certain applications it may be useful to enhance infrared light absorption in infrared sensitized photographic elements to achieve greater sensitivity and image quality characteristics.

SUMMARY OF THE INVENTION

In application Ser. No. 09/151,974, filed Sep. 11, 1998 incorporated herein by reference) we described increased light absorption in a photographic system. This is achieved by forming two dye layers on silver halide or by use of at least one dye having at least one anionic substituent and at least one dye having at least one cationic substituent. However, we have found that increasing light absorption in this manner is less effective than desired in photographic materials that contain anionic surfactants, such as those generally used to make color coupler dispersions. We have now found that certain dye structures provide the desired enhanced light absorption in a color photographic element, including photographic elements that contain an anionic surfactant in the coupler dispersion.

We have found that it is possible to form more than one dye layer on silver halide emulsion grains and that this can afford increased light absorption. The dye layers are held together by preferably more than one non-covalent attractive force such as electrostatic bonding, van der Waals interactions, hydrogen bonding, hydrophobic interactions, dipole-dipole interactions, dipole-induced dipole interactions, London dispersion forces, cation—πinteractions, etc. The outer dye layer(s) (also referred to as an antenna dye layer(s)) adsorbs light at an equal or higher energy (equal or shorter wavelength) than the adjacent inner dye layer. The energy emission wavelength of the outer dye layer(s) overlaps with the energy absorption wavelength of the adjacent inner dye layer.

We have also found that a silver halide color photographic material in which silver halide grains sensitized with at least one dye containing at least one anionic substituent and at last one dye containing at least one cationic substituent provides increased light absorption.

One aspect of this invention comprises a silver halide color photographic material comprising at least one silver halide emulsion comprising silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one cyanine dye, Dye 2, wherein one of Dye 1 or Dye 2 has at least one anionic substituent and one of Dye 1 or Dye 2 has at least one cationic substituent and wherein the dye layers are held together by more than one non-covalent force; the outer dye layer adsorbs light at equal or higher energy than the inner dye layer; and the energy emission wavelength of the outer dye layer overlaps with the energy absorption wavelength of the inner dye layer.

Another aspect of this invention comprises a color photographic material comprising at least one silver halide emulsion comprising silver halide grains having associated therewith at least one dye which contains an anionic substituent and at least one dye that has a cationic substituent.

ADVANTAGEOUS EFFECT OF THE INVENTION

The light absorption and photographic sensitivity of a photographic element is increased by forming more than one layer of dye on silver halide grains. Further good color reproduction, i.e., minimal unwanted photographic sensitivity in more than one color record is achieved.

DETAILED DESCRIPTION OF THE INVENTION

The goals of the current invention can be achieved by forming a silver halide photographic material comprising at least one silver halide emulsion comprising silver halide grains having associated therewith at least two dye layers, wherein the dye layers are held together by more than one non-covalent force; the outer dye layer adsorbs light at equal or higher energy than the adjacent inner dye layer which is adjacent to the silver halide grain; and the energy emission wavelength of the outer dye layer overlaps with the energy absorption wavelength of the inner dye layer and dyes of the inner layer are capable of spectrally sensitizing silver halide.

To determine that increased light absorption by the photographic element has occurred as a result of forming an outer dye layer in addition to the inner dye layer, it is necessary to compare the overall absorption of the emulsion subsequent to the addition of the dye or dyes of the inner dye layer with the overall absorption of the emulsion subsequent to the further addition of the dye or dyes of an outer dye layer. This measurement of absorption can be done in a variety of ways known in the art, but a particularly convenient and directly applicable method is to measure the absorption spectrum as a function of wavelength of a coating prepared on a planar support from the liquid emulsion in the same manner as is conventionally done for photographic exposure evaluation. The methods of measurement of the total absorption spectrum, in which the absorbed fraction of light incident in a defined manner on a sample as a function of the wavelength of the impinging light for a turbid material such as a photographic emulsion coated onto a planar support have been described in detail (for example see F. Grum and R. J. Becherer, "Optical Radiation Measurements, Vol. 1, Radiometry", Academic Press, New York, 1979). The absorbed fraction of incident light can be designated by $A(\lambda)$, where A is the fraction of incident light absorbed and $\lambda$ is the corresponding wavelength of light. Although $A(\lambda)$ is itself a useful parameter allowing graphical demonstration of the increase in light absorption resulting from the formation of additional dye layers described in this invention, it is desirable to replace such a graphical comparison with a numerical one. Further, the effectiveness with which the light absorption capability of an emulsion coated on a planar support is converted to photographic image depends, in addition to $A(\lambda)$, on the wavelength distribution of the irradiance $I(\lambda)$ of the exposing light source. (Irradiance at different wavelengths of light sources can be obtained by well-known measurement techniques. See, for example, F. Grum and R. J. Becherer, "Optical Radiation Measurements, Vol. 1, Radiometry", Academic Press, New York, 1979.) A further refinement follows from the fact that photographic image formation is, like other photochemical processes, a quantum effect so that the irradiance, which is usually measured in units of energy per unit time per unit area, needs to be converted into quanta of light $N(\lambda)$ via the formula $N(\lambda)=I(\lambda)\lambda/hc$ where h is Planck's constant and c is the speed of light. Then the number of absorbed photons per unit time per unit area at a given wavelength for a photographic coating is given by: $N_a(\lambda)=A(\lambda)N(\lambda)$. In most instances, including the experiments described in the Examples of this invention, photographic exposures are not performed at a single or narrow range of wavelengths but rather involve a broad spectrum of wavelengths designed to simulate a particular illuminant found in real photographic situations, for example daylight. Therefore the total number of photons of light absorbed per unit time per unit area from such an illuminant consists of a summation or integration of all the values of the individual wavelengths, that is: $N_a=\int A(\lambda)N(\lambda)d\lambda$, where the limits of integration correspond to the wavelength limits of the specified illuminant. In the Examples of this invention comparison is made on a relative basis between the values of the total number of photons of light absorbed per unit time per unit area of the coating of emulsion containing sensitizing inner dye layer set to a value of 100 alone and the total number of photons of light absorbed per unit time of the coatings containing sensitizing outer dye layer in addition to inner dye layer. These relative values of $N_a$ are designated as Normalized Relative Absorption and are tabulated in the Examples. Enhancement of the Normalized Relative Absorption is a quantitative measure of the advantageous light absorption effect of this invention.

As stated in the Background of the Invention, some previous attempts to increase light absorption of emulsions resulted in the presence of dye that was too remote from the emulsion grains to effect energy transfer to the dye adsorbed to the grains, so that significant increase in photographic sensitivity was not realized. Thus an enhancement in Relative Absorption by an emulsion is alone not a sufficient measurement of the effectiveness of additional dye layers. For this purpose a metric must be defined that relates the enhanced absorption to the resulting increase in photographic sensitivity. Such a parameter is now described.

Photographic sensitivity can be measured in various ways. One method commonly practiced in the art and described in numerous references (for example in The Theory of the Photographic Process, 4th edition, T. H. James, editor, Macmillan Publishing Co., New York, 1977) is to expose an emulsion coated onto a planar substrate for a specified length of time through a filtering element, or tablet interposed between the coated emulsion and light source which - modulates the light intensity in a series of uniform steps of constant factors by means of the constructed increasing opacity of the filter elements of the tablet. As a result the exposure of the emulsion coating is spatially reduced by this factor in discontinuous steps in one direction, remaining constant in the orthogonal direction. After exposure for a time required to cause the formation of developable image through a portion but not all the exposure steps, the emulsion coating is processed in an appropriate developer, either black and white or color, and the densities of the image steps are measured with a densitometer. A graph of exposure on a relative or absolute scale, usually in logarithmic form, defined as the irradiance multiplied by the exposure time, plotted against the measured image density can then be constructed. Depending on the purpose, a suitable image density is chosen as reference (for example 0.15 density above that formed in a step which received too low an exposure to form detectable exposure-related image). The exposure required to achieve that reference density can then be determined from the constructed graph, or its electronic counterpart. The inverse of the exposure to reach the reference density is designated as the emulsion coating sensitivity S. The value of $Log_{10}S$ is termed the speed. The exposure can be either monochromatic over a small wavelength range or consist of many wavelengths over a broad spectrum as already described. The film sensitivity of emulsion coatings containing only the inner dye layer or, alternatively, inner dye layer plus outer dye layer can be measured as described using a specified light source, for example a simulation of daylight. The photographic sensitivity of a particular example of an emulsion coating containing inner dye layer plus outer dye layer can be compared on a relative basis with a corresponding reference of an emulsion coating containing only inner dye layer by setting S for the latter equal to 100 and multiplying this times the ratio of S for the invention example coating containing inner dye layer plus outer dye layer to S for the comparison example containing only inner dye layer. These values are designated as Normalized Relative Sensitivity. They are tabulated in the Examples along with the corresponding speed values. Enhancement of the Normalized Relative Sensitivity is a quantitative measure of the advantageous photographic sensitivity effect of this invention. As a result of these measurements of emulsion coating absorption and photographic sensitivity, one obtains two sets of parameters for each example, $N_a$ and S, each relative to 100 for the comparison example containing only inner dye layer. The exposure source used to calculate $N_a$ should be the same as that used to obtain S. The increase in these parameters $N_a$ and S over the value of 100 then represent respectively the increase in absorbed photons and in photographic sensitivity resulting from the addition of sensitizing dye outer dye layer of this invention. These increases are labeled respectively $\Delta N_a$ and $\Delta S$. It is the ratio of $\Delta S/\Delta N_a$ that measures the effectiveness of the outer dye layer to increase photographic sensitivity. This ratio, multiplied by 100 to convert to a percentage, is designated the Layering Efficiency, designated E, and is tabulated in the Examples along with S and $N_a$. The Layering Efficiency measures the effectiveness of the increased absorption of this invention to increase photographic sensitivity. When either $\Delta S$ or $\Delta Na$ is zero, then the Layering Efficiency is effectively zero.

In a preferred embodiment the following relationship is met:

$$E=100\Delta S/\Delta N_a \geqq 10 \text{ and } \Delta N_a \geqq 10$$

wherein

E is the layering efficiency;

$\Delta S$ is the difference between the Normalized Relative Sensitivity (S) of an emulsion sensitized with the inner dye layer and the Normalized Relative Absorption of an emulsion sensitized with the inner dye layer and the outer dye layer; and $\Delta N_a$ is the difference between the Normalized Relative Absorption ($N_a$) of an emulsion sensitized with the inner dye layer and the Normalized Relative Absorption of an emulsion sensitized with the inner dye layer and the outer dye layer.

Examples of non-covalent attractive forces include electrostatic attraction, hydrophobic interactions, hydrogen-bonding, and van der Waals interactions, dipole-dipole interactions, dipole-induced dipole interactions, London dispersion forces, cation—$\pi$interactions. We have found that if just one of these non-covalent attractive forces is used then the layers can be easily disrupted by external factors. For example, dispersions of color couplers commonly used in photographic systems are most often formulated by using anionic surfactants. If dye layers are formed on a silver halide emulsion and electrostatic attraction is the only primary force used to bind the dye layers to one another, then the addition of competitor such as a color coupler dispersion containing an anionic surfactant can lead to disruption of the dye layers. We have found that the dye layers are much more robust if the dye structures are designed in such a way that more then one non-covalent attractive force is used to hold the layers together. For example, the use of complimentary dyes that can interact by electrostatic and van der Waals forces improves the stability of the dye layers. In one preferred embodiment the a silver halide emulsion is dyed with a saturation or near saturation monolayer of one or more cyanine dyes which have either a positive or negative net charge. The area a dye covers on the silver halide surface can be determined by preparing a dye concentration series and choosing the dye level for optimum performance or by well-known techniques such as dye adsorption isotherms (for example see W. West, B. H. Carroll, and D. H. Whitcomb, J. Phys. Chem, 56, 1054 (1962)). The second layer consists of dyes which have a net charge of opposite sign compared to the dyes of the first layer. We have found that these layers are much more robust if the dyes also have at least one aromatic substituent that can provide additional binding by van der Waals forces. Likewise, substitutents that provide both electrostatic interactions and hydrogen binding, such as guanidinium groups, are more likely to be stable in the presence of color coupler dispersion. For example, a silver halide emulsion is optimally dyed with one or more cyanine dyes which have at least one anionic substituent, such as a 3-sulfopropyl group which is a hydrogen-bond acceptor. The second layer consists of dyes which have at least one cationic guanidinium substituent which is a hydrogen bond donor. The cationic guanidinium substituents of the dyes of the second layer can interact with the anionic substitutents of the first layer through electrostatics, forming ionic bonds, and by hydrogen bonding. We have found that these layers are much more robust in color systems then analogous layers that are held only by electrostatic forces.

We have also found that the disruption of dye layering by color coupler dispersions containing anionic surfactant can be minimized by formulating the outer antenna layer(s) such that they consist of a mixture of dyes with at least one substituent that has a positive charge and dyes with at least one substituent that has a negative charge. This mixture can form a robust dye layer by internal electrostatic interactions. Cyanine dyes with anionic substituents are well know in the literature (see F. M. Hamer, Cyanine Dyes and Related Compounds, 1964 (publisher John Wiley & Sons, New York, N.Y.)). Cyanine dyes with cationic substituents have been described in U.S. Pat. No. 4,028,353 (also see U.S. Pat. No. 2,256,163 and U.S. Pat. No. 2,354,524).

In one preferred embodiment, the secondary (non-silver halide adsorbed) antenna dye layer can form a well-ordered liquid-crystalline phase (a lyotropic mesophase) in aqueous media (e.g. water, aqueous gelatin, methanolic aqueous gelatin, etc.), and preferably forms a smectic liquid-crystalline phase (W. J.Harrison, D. L. Mateer & G. J. T. Tiddy, *J.Phys.Chem.* 1996, 100, pp 2310–2321). More specifically, in one embodiment preferred secondary layer dyes will form liquid-crystalline J-aggregates in aqueous-based media (in the absence of silver halide grains) at any equivalent molar concentration equal to, or 4 orders of magnitude greater than, but more preferably at any equivalent molar concentration equal to or less than, the optimum level of primary silver halide-adsorbed dye deployed for conventional sensitization (see The Theory of the Photographic Process, $4^{th}$ edition, T. H. James, editor, Macmillan Publishing Co., New York, 1977, for a discussion of aggregation).

Mesophase-forming dyes may be readily identified by someone skilled in the art using polarized-light optical microscopy as described by N. H. Hartshorne in The Microscopy of Liquid Crystals, Microscope Publications Ltd., London, 1974. In one embodiment, preferred antenna dyes when dispersed in the aqueous medium of choice (including water, aqueous gelatin, aqueous methanol etc. with or without dissolved electrolytes, buffers, surfactants and other common sensitization addenda) at optimum concentration and temperature and viewed in polarized light as thin films sandwiched between a glass microscope slide and cover slip display the birefringence textures, patterns and flow rheology characteristic of distinct and readily identifiable structural types of mesophase (e.g. smectic, nematic, hexagonal). Furthermore, in one embodiment, the preferred dyes when dispersed in the aqueous medium as a liquid-crystalline phase generally exhibit J-aggregation resulting in a unique bathochromically shifted spectral absorption band yielding high fluorescence intensity. In another embodiment useful hypsochromically shifted spectral absorption bands may also result from the stabilization of a liquid-crystalline phase of certain other preferred dyes. In certain other embodiments of dye layering, especially in the case of dye layering via in situ bond formation, it may be desirable to use antenna dyes that do not aggregate.

In describing preferred embodiments of the invention, one dye layer is described as an inner layer and one dye layer is described as an outer layer. It is to be understood that one or more intermediate dye layers may be present between the inner and outer dye layers, in which all of the layers are held together by non-covalent forces, as discussed in more detail above. Further, the dye layers need not completely encompass the silver halide grains of underlying dye layer(s). Also some mixing of the dyes between layers is possible.

The dyes of the inner dye layer are preferably any dyes capable of spectral sensitization, for example, a cyanine dye, merocyanine dye, complex cyanine dye, complex merocyanine dye, homopolar cyanine dye, or hemicyanine dye, etc. Of these dyes, merocyanine dyes containing a thiocarbonyl group and cyanine dyes are particularly useful. Of these cyanine dyes are especially useful.

In a preferred embodiment of the invention, the dye layers are preferably formed by a combination of at least one dye of Formula I and at least one dye of Formula II.

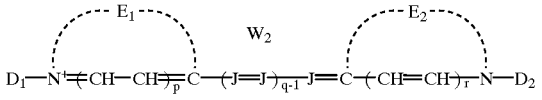

wherein:

$E_1$ and $E_2$ may be the same or different and represent the atoms necessary to form a substituted or unsubstituted heterocyclic ring which is a basic nucleus (see The Theory of the Photographic Process, $4^{th}$ edition, T. H. James, editor, Macmillan Publishing Co., New York, 1977 for a definition of basic and acidic nucleus), each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl and at least one of $D_1$ and $D_2$ contains an anionic substituent, $W_2$ is one or more a counterions as necessary to balance the charge;

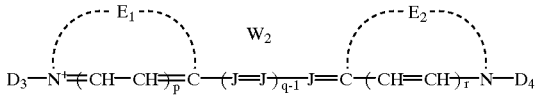

wherein:

$E_1$, $E_2$, J, p, q and $W_2$ are as defined above for Formula (I), $D_3$ and $D_4$ each independently represents substituted or unsubstituted alkyl or unsubstituted aryl and $D_3$ and $D_4$ do not contain an anionic substituent and preferably at least one of $E_1$, $E_2$, J or $D_3$ and $D_4$ contains a cationic substituent, Preferably if $D_3$ and $D_4$ contains an aromatic or heteroaromatic group then D1 and D2 do not contain an aromatic or heteroaromatic group, In one preferred embodiment the dye of the first layer is of Formula I and the dye of the outer antenna layer(s) is of Formula II. In another preferred embodiment the dye of the first layer is of Formula I and the antenna layer(s) contain both a positively charged dye of Formula II and negatively charged dye of Formula II wherein the dyes of Formula I in the first layer and the antenna layers can be selected independently.

Particularly preferred as dyes adjacent to the silver halide emulsion are dyes of Formula Ib and particularly preferred as dyes that form the antenna dye layer(s) are dyes of Formula IIb, Ib

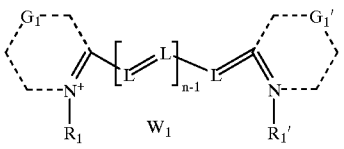

-continued

IIb

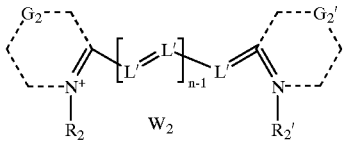

wherein:

$G_1$ and G1' independently represent the atoms necessary to complete a benzothiazole nucleus, benzoxazole nucleus, benzoselenazole nucleus, benzotellurazole nucleus, quinoline nucleus, or benzimidazole nucleus in which $G_1$ and $G_{1'}$ independently may be substituted or unsubstituted and preferably either G1 or G1' contains at least one aromatic or heteroaromatic subsitutent;

$G_2$ and $G_2$' independently represent the atoms necessary to complete a benzothiazole nucleus, benzoxazole nucleus, benzoselenazole nucleus, benzotellurazole nucleus, quinoline nucleus, indole nucleus, or benzimidazole nucleus in which $G_2$, and $G_2$' independently may be substituted or unsubstituted and preferably either G1 or G1' contains at least one aromatic or heteroaromatic subsitutent;

n and n' are independently a positive integer from 1 to 4, each L independently represents a substituted or unsubstituted methine group, $R_1$ and $R_1$' each independently represents substituted or unsubstituted aryl or substituted or unsubstituted aliphatic group, at least one of $R_1$ and $R_1$' has a negative charge, $W_1$ is a cationic counterion to balance the charge if necessary, $R_2$ and $R_2$' each independently represents substituted or unsubstituted aryl or substituted or unsubstituted aliphatic group and at least one of $R_2$ and $R_2$' has a positive charge; such that the net charge of II is +1, +2, +3, +4, or +5, $W_2$ is one or more anionic counterions to balance the charge.

In one preferred embodiment of the inventions at least one dye adjacent to the silver halide is of Formula Ic Ic

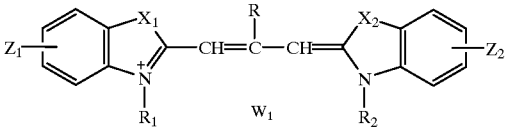

wherein:

$X_1$ and $X_2$, independently represent S, Se, O, or N—R' (where R' is substituted or unsubstituted alkyl or substituted or unsubstituted aryl) with the proviso that at least one of $X_1$ and $X_2$ is, O;

$Z_1$ and $Z_2$, each contain independently at least one substituted or unsubstituted aromatic group;

R is hydrogen, substituted or unsubstituted lower alkyl, substituted or unsubstituted aryl, or substituted or unsubstituted alkylaryl;

$R_1$ and $R_2$ each independently represents substituted or unsubstituted aryl or substituted or unsubstituted aliphatic group, with the proviso that at least one of $R_1$ and $R_2$ has a negative charge; and $W_1$ is a cationic counter ion if needed to balance the charge.

In one preferred embodiment of the invention, the inner layer contains at least one dye of Formula Ic, above, and an outer layer contains at least one dye of Formula IIc:

IIc

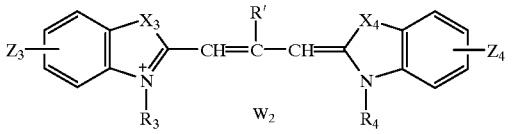

wherein:

$X_3$ and $X_4$ independently represent S, Se, O or N—R', (where R' is substituted or unsubstituted alkyl or substituted or unsubstituted aryl), with the proviso that at least one of at least one of $X_3$ and $X_4$ is O, $Z_3$ and $Z_4$ each independently contain at least one substituted or unsubstituted aromatic group;

R' is hydrogen, substituted or unsubstituted lower alkyl, substituted or unsubstituted aryl or substituted or unsubstituted alkylaryl;

$R_3$ and $R_4$ each independently represents substituted or unsubstituted aryl or substituted or unsubstituted aliphatic group, with the proviso that $R_3$ and $R_4$ have a net charge of zero or greater; and $W_2$ is a anionic counter ion to balance the charge if necessary.

In another preferred embodiment, a molecule containing a group that strongly bonds to silver halide, such as a mercapto group (or a molecule that forms a mercapto group under alkaline or acidic conditions) or a thiocarbonyl group is added after the first dye layer has been formed and before the second dye layer is formed. Mercapto compounds represented by the following formula (A) are particularly preferred.

A

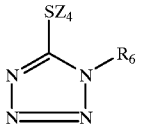

wherein $R_6$ represents an alkyl group, an alkenyl group or an aryl group and $Z_4$ represents a hydrogen atom, an alkali metal atom, an ammonium group or a protecting group that can be removed under alkaline or acidic

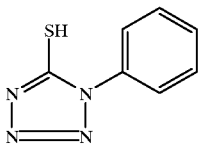

A-1

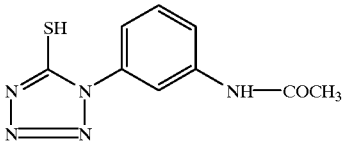

A-2

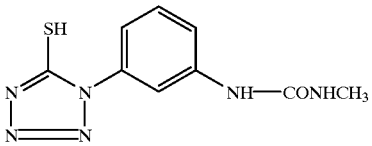

A-3

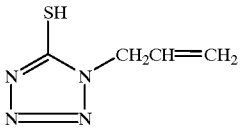

A-4

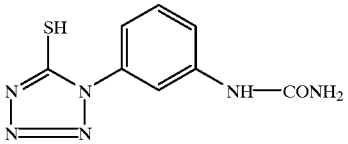

A-5

In on preferred embodiment at least one dye in the first layer contains a benzoxazole nucleus substituted with at least one aromatic or heteroaromatic substituent such as a phenyl group, a pyrrole group, etc. and at least one dye in the outer antenna dye layer also contains a benzoxazole nucleus substituted with at least one aromatic or heteroaromatic substituent.

In some cases, during dye addition and sensitization of the silver halide emulsion, it appears that silver halide grains of opposite charge may be formed. This can result in grain clumping or adhesion of the grains to one another. This is undesirable because it can affect image quality. We have found that this problem can be avoided by adding gelatin during the emulsion sensitization process. The gelatin can be added before dye addition or after the first dye is added but before the dye of opposite charge is added.

Examples of positively charged substituents are 3-(trimethylammonio)propyl), 3-(4-ammoniobutyl), 3-(4-guanidinobutyl), 3-(4-amidinobutyl), etc. Other examples are any substitutents that take on a positive charge in the silver halide emulsion melt, for example, by protonation such as aminoalkyl substitutents, e.g. 3-(3-aminopropyl), 3-(3-dimethylaminopropyl), 4-(4-methylaminopropyl), etc. Examples of negatively charged substituents are 3-sulfopropyl, 2-carboxyethyl, 4-sulfobutyl, etc.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Examples of dye structures I and II are listed below in Table I:

TABLE I

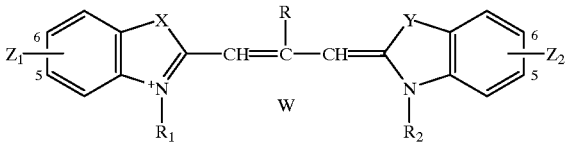

| Dye | X,Y | $R_1$ | $R_2$ | R | $Z_1$ | $Z_2$ | W | Net Charge |
|---|---|---|---|---|---|---|---|---|
| I-1 | O,O | $—(CH_2)_2CH(Me)SO_3^-$ | $—(CH_2)_2CH(Me)SO_3^-$ | Et | 5-Ph | 5-Ph | $TEAH^+$ | −1 |
| I-2 | O,O | $—(CH_2)_3SO_3^-$ | $—(CH_2)_3SO_3^-$ | Et | 5-Ph | 5-Ph | $TEAH^+$ | −1 |
| I-3 | O,O | $—(CH_2)_2SO_3^-$ | $—(CH_2)_2SO_3^-$ | Et | 5-Ph | 5-Ph | $TEAH^+$ | −1 |
| I-4 | O,O | $—(CH_2)_3SO_3^-$ | $—(CH_2)_3SO_3^-$ | Et | 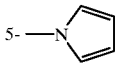 | 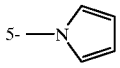 | $Na^+$ | −1 |
| I-5 | O,S | $—(CH_2)_2CH(Me)SO_3^-$ | $—CH_2CH_3$ | Et | 5-Ph | 5-Ph | — | 0 |
| I-6 | O,O | $—(CH_2)_2CH(Me)SO_3^-$ | $—(CH_2)_3SO_3^-$ | Et | 5-Ph | 5-Cl | $TEAH^+$ | −1 |
| I-7 | O,S | $—CH_2CH_3$ | $—CH_2CONSO_2Me^-$ | Et | 5-Ph | 5-H | — | 0 |
| I-8 | O,S | $—(CH_2)_3SO_3^-$ | $—(CH_2)_3SO_3^-$ | Et | 5-Ph | 5-Cl | $TEAH^+$ | −1 |
| I-9 | S,S | $—(CH_2)_3SO_3^-$ | $—(CH_2)_3SO_3^-$ | Et | Cl | Cl | $TEAH^+$ | −1 |
| I-10 | S,S | $—(CH_2)_3SO_3^-$ | $—(CH_2)_3SO_3^-$ | Et | Ph | Ph | $Na^+$ | −1 |
| I-11 | S,S | $—(CH_2)_3OPO_3^{-2}$ | $—C_2H_5$ | Et | Cl | Cl | $Na^+$ | −1 |
| I-12 | S,S | $—(CH_2)_3SO_3^-$ | $—(CH_2)_3SO_3^-$ | Et | 4,5Benzo | 4,5Benzo | $TEAH^+$ | −1 |
| II-1 | O,O | $—(CH_2)_3N(Me)_3^+$ | $—(CH_2)_3SO_3^-$ | Et | Ph | Cl | $Br^-$ | +1 |
| II-2 | O,O | $—(CH_2)_3N(Me)_3^+$ | $—(CH_2)_3N(Me)_3^+$ | Et | Ph | Ph | $3Br^-$ | +3 |
| II-3 | O,O | $—(CH_2)_3N(Et)_3^+$ | $—(CH_2)_3N(Et)_3^+$ | Et | Ph | Ph | $3Br^-$ | +3 |
| II-4 | O,O | $—(CH_2)_3N(Pr)_3^+$ | $—(CH_2)_3N(Pr)_3^+$ | Et | Ph | Ph | $3Br^-$ | +3 |
| II-5 | O,O | 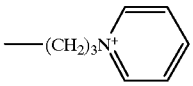 | 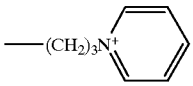 | Et | Ph | Ph | $3Br^-$ | +3 |
| II-6 | O,O | 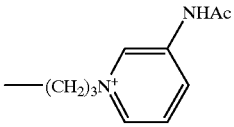 | 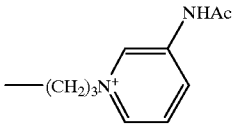 | Et | Ph | Ph | $3Br^-$ | +3 |
| II-7 | O,O | 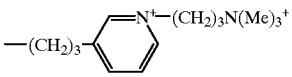 | 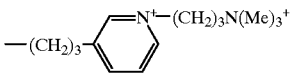 | Et | Ph | Ph | $5Br^-$ | +5 |

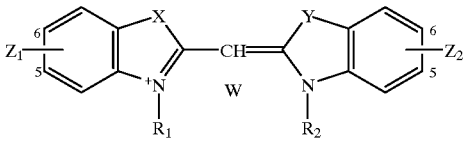

| Dye | $Z_1$ | $Z_2$ | X,Y | $R_1$ | $R_2$ | W | Net Charge |
|---|---|---|---|---|---|---|---|

TABLE I-continued

| | | | | | | | |
|---|---|---|---|---|---|---|---|
| I-13 | 5-Cl | 5-Cl | S,S | —$(CH_2)_3SO_3^-$ | —$(CH_2)_3SO_3^-$ | $Na^+$ | −1 |
| I-14 | 5-Ph | 5-Ph | S,s | —$(CH_2)_3SO_3^-$ | —$(CH_2)_3SO_3^-$ | $Na^+$ | −1 |
| II-8 | 5-Cl | 5-Cl | S,S | —$(CH_2)_3N(Me)_3^+$ | —$C_2H_5$ | $2Br^-$ | +2 |
| II-9 | 5-Cl | 5-Cl | S,S | —$(CH_2)_3N(Me)_3^+$ | —$(CH_2)_3N(Me)_3^+$ | $3Br^-$ | +3 |
| II-10 | 5-Cl | 5-Cl | S,S | —$(CH_2)_4$—NH—C(=$NH_2^+$)$NH_2$ | $(CH_2)_3SO_3^-$ | $Br^-$ | +1 |
| II-11 | 5-Ph | 5-Ph | S,S | —$(CH_2)_4$—NH—C(=$NH_2^+$)$NH_2$ | —$(CH_2)_4$—NH—C(=$NH_2^+$)$NH_2$ | $3Br^-$ | +3 |
| II-12 | 5-Ph | 5-Ph | S,O | —$(CH_2)_4$—$CH_2$—C(=$NH_2^+$)$NH_2$ | —$(CH_2)_4$—$CH_2$—C(=$NH_2^+$)$NH_2$ | $3Cl^-$ | +3 |
| II-13 | 5-Cl | 5-Cl | S,S | —$(CH_2)_4$—NH—C(=$NH_2^+$)$NH_2$ | —$(CH_2)_4$—NH—C(=$NH_2^+$)$NH_2$ | $3Br^-$ | +3 |
| II-14 | 5-Ph | 5-Cl | S,S | —$(CH_2)_3NH_2$ | —$(CH_2)_3NH_2$ | $Br^-$ | +1 (+3)* |
| II-15 | 5-Ph | 5-Cl | S,S | —$(CH_2)_3NH_2$ | $(CH_2)_3SO_3^-$ | — | 0 (+1)* |
| II-16 | 5-Ph | 5-Cl | S,S | —$(CH_2)_3NH_2$ | —$C_2H_5$ | $Br^-$ | +1 (+2)* |

Me is methyl, Et is ethyl, Pr is propyl, Ph is phenyl, $TEAH^+$ is triethylammonium
*Charge when protonated The emulsion layer of the photographic element of the invention can comprise any one or more of the light sensitive layers of the photographic element. The photographic elements made in accordance with the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in Research Disclosure, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to Research Disclosure, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in Research Disclosure, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area.

The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (?m). The tabular grains can be of any thickness compatible with achieving an aim average aspect ratio and/or average tabularity of the tabular grain emulsion. Preferably the tabular grains satisfying projected area requirements are those having thicknesses of <0.3 ?m, thin (<0.2 ?m) tabular grains being specifically preferred and ultrathin (<0.07 ?m) tabular grains being contemplated for maximum tabular grain performance enhancements. When the native blue absorption of iodohalide tabular grains is relied upon for blue speed, thicker tabular grains, typically up to 0.5 ?m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in Research Disclosure I, Section I.B.(3) (page 503).

The silver halide grains to be used in the invention may be prepared according to methods known in the art, such as those described in Research Disclosure I and The Theory of the Photographic Process, $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in Research Disclosure, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in Research Disclosure I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in Research Disclosure I. The vehicle can be present in the emulsion in any amount useful in photographic emulsions. The emulsion can also include any of the addenda known to be useful . in photographic emulsions.

The silver halide to be used in the invention may be advantageously subjected to chemical sensitization. Compounds and techniques useful for chemical sensitization of silver halide are known in the art and described in Research Disclosure I and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in Research Disclosure I, Section IV (pages 510–511) and the references cited therein.

The silver halide may be sensitized by sensitizing dyes by any method known in the art, such as described in Research Disclosure I. The dyes may, for example, be added as a solution or dispersion in water, alcohol, aqueous gelatin, alcoholic aqueous gelatin, etc.. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in Research Disclosure I, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in Research Disclosure I, or in The Theory of the Photographic Process, $4^{th}$ edition, T. H. James, editor, Macmillan Publishing Co., New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(?-(methanesulfonamido) ethylaniline sesquisulfate hydrate, 4-amino-3-methyl-N-ethyl-N-(?-hydroxyethyl)aniline sulfate, 4-amino-3-?-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol. 116, December, 1973, Item 11660, and Bissonette Research Disclosure, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

Example of Dye Synthesis (3-Bromopropyl)trimethylammonium bromide was obtained from Aldrich. The bromide salt was converted to the hexafluorophosphate salt to improve the compounds solubility in valeronitrile. Reaction of a heterocyclic base with 3-(bromopropyl)trimethylammonium hexafluorophosphate in valeronitrile at 135° C. gave the corresponding quaternary salt. For example, reaction of 2-methyl-5-phenylbenzoxazole with 3-(bromopropyl) trimethylammonium hexafluorophosphate gave 2-methyl-5-phenyl-(3-(trimethylammonio)propyl)benzoxazolium bromide hexafluorophosphate. Which could be converted to the bis-bromide salt with tetrabutylammonium bromide. Dyes were prepared from quaternary salt intermediates by standard methods such as described in F. M. Hamer, Cyanine Dyes and Related Compounds, 1964 (publisher John Wiley & Sons, New York, N.Y.) and James, The Theory of the Photographic Process 4th edition, 1977 (Eastman Kodak Company, Rochester, N.Y.). For example reaction of 5-phenyl-2-methyl-3-(3-(trimethylammonio)propyl) benzoxazolium bromide hexafluorophosphate with triethylorthopropionate and triethylamine in m-cresol followed by treatment with tetrabutylammonium bromide gave 5,5'-diphenyl-9-ethyl-3,3'-di(3-(trimethylammonio)propyl) oxacyanine tribromide.

Example of Phase Behavior and Spectral Absorption Properties of Dyes Dispersed in Aqueous Gelatin Dye dispersions (5.0 gram total weight) were prepared by combining known weights of water, deionized gelatin and solid dye into screw-capped glass vials which were then thoroughly mixed with agitation at 60° C.–80° C. for 1–2 hours in a Lauda model MA 6 digital water bath. Once homogenized, the dispersions were cooled to room temperature. Following thermal equilibration, a small aliquot of the liquid dispersion was tranferred to a thin-walled glass capillary cell (0.0066 cm pathlength) using a pasteur pipette. The thin-film dye dispersion was then viewed in polarized light at 16× objective magnification using a Zeiss Universal M microscope fitted with polarizing elements. Dyes forming a liquid-crystalline phase (i.e. a mesophase) in aqueous gelatin were readily identified microscopically from their characteristic birefringent type-textures, interference colours and shear-flow characteristics. (In some instances, polarized-light optical microscopy observations on thicker films of the dye dispersion, contained inside stoppered 1 mm pathlength glass cells, facilitated the identification of the dye liquid-crystalline phase). For example, dyes forming a lyotropic nematic mesophase typically display characteristic fluid, viscoelastic, birefringent textures including so-called Schlieren, Tiger-Skin, Reticulated, Homogeneous (Planar), Thread-Like, Droplet and Homeotropic (Pseudoisotropic). Dyes forming a lyotropic hexagonal mesophase typically display viscous, birefringent Herringone, Ribbon or Fan-Like textures. Dyes forming a lyotropic smectic mesophase typically display so-called Grainy-Mosaic, Spherulitic, Frond-Like (Pseudo-Schlieren) and Oily-Streak birefringent textures. Dyes forming an isotropic solution phase (non-liquid-crystalline) appeared black (i.e. non-birefringent) when viewed microscopically in polarized light. The same thin-film preparations were then used to determine the spectral absorption properties of the aqueous gelatin-dispersed dye using a Hewlett Packard 8453 UV-visible spectrophotometer. Representative data are shown in Table A.

TABLE A

| Dye | Dye Conc. (% w/w) | Gelatin Conc. (% w/w) | Physical State of Dispersed Dye | Dye Aggregate Type |
|---|---|---|---|---|
| II-8 | 0.20 | 3.5 | isotropic solution | H-aggregate |
| II-9 | 0.13 | 3.5 | isotropic solution | H-aggregate |
| I-13 | 0.03 | 3.5 | smectic liquid crystal | J-aggregate |
| II-10 | 0.06 | 3.5 | smectic liquid crystal | J-aggregate |
| II-11 | 0.06 | 3.5 | isotropic solution | H-aggregate |
| I-6 | 0.05 | 3.5 | smectic liquid crystal | J-aggregate |
| I-8 | 0.10 | 3.5 | smectic liquid crystal | J-aggregate |
| II-2 | 0.20 | 3.5 | smectic liquid crystal | J-aggregate |
| II-5 | 0.20 | 3.5 | smectic liquid crystal | J-aggregate |
| II-7 | 0.12 | 3.5 | isotropic solution | H-aggregate |
| II-3 | 0.30 | 3.5 | smectic liquid crystal | J-aggregate |
| II-4 | 0.25 | 3.5 | smectic liquid crystal | J-aggregate |
| I-1 | 0.05 | 3.5 | smectic liquid crystal | J-aggregate |
| II-6 | 0.13 | 3.5 | smectic liquid crystal | J-aggregate |
| I-9 | 0.05 | 3.5 | smectic liquid crystal | J-aggregate |
| I-4 | 0.02 | 3.5 | smectic liquid crystal | J-aggregate |
| II-1 | 0.06 | 3.5 | smectic liquid crystal | J-aggregate |

The data clearly demonstrate that the thermodynamically stable form of most inventive dyes when dispersed in aqueous gelatin as described above (in the absence of silver halide grains) is liquid crystalline. Furthermore, the liquid-crystalline form of these inventive dyes is J-aggregated and exhibits a characteristically sharp, intense and bathochromically shifted J-band spectral absorption peak, generally yielding strong fluorescence. In some instances the inventive dyes possessing low gelatin solubility preferentially formed a H-aggregated dye solution when dispersed in aqueous gelatin, yielding a hysochromically-shifted H-band spectral absorption peak. Ionic dyes exhibiting the aforementioned aggregation properties were found to be particularly useful as antenna dyes for improved spectral sensitization when used in combination with an underlying silver halide-adsorbed dye of opposite charge.

EXAMPLE 1

Photographic Evaluation

Film coating evaluations were carried out in color format on a sulfur-and-gold sensitized 0.2 $\mu$m cubic silver bromide emulsion containing iodide (2.5 mol %). The emulsion (0.0143 mole Ag) was heated to 40° C. The first sensitizing dye (see Table II for dye level) was added and then the melt was heated to 60° C. for 15'. After cooling to 40° C., gelatin (971 g/Ag mole total) was added and then the second dye (see Table II for dye level), when present, was added to the melts after the finish cycle, but prior to dilution of the melts.

Single-layer coatings were made on acetate support. Total gelatin laydown was 4.8 g/m$^2$ (450 mg/ft$^2$). Silver laydown was 0.5 g/m$^2$ (50 mg/ft$^2$). The emulsion was combined with a coupler dispersion containing 2-(2,4-bis(1,1-dimethylpropyl)phenoxy)-N-(4-((((4-cyanophenyl)amino) carbonyl)amino)-3-hydroxyphenyl)-hexanamide just prior to coating. This is a cyan dye forming coupler and would normally be used in an emulsion layer with a red sensitizing dye. To facilitate analysis in a single layer coating, green sensitizing dyes were also being coated with this coupler. It is understood, however, that for traditional photographic applications the green sensitizing dyes of this invention would be used in combination with a magenta dye forming coupler.

Sensitometric exposures (1.0 sec) were done using 365 nm Hg-line exposure or a tungsten exposure with filtration to stimulate a daylight exposure. The described elements were processed for 3.25' in the known C-41 color process as described in Brit. J. Photog. Annual of 1988, p191–198 with the exception that the composition of the bleach solution was changed to comprise propylenediaminetetraacetic acid. Results are shown in the Table II.

TABLE II

Sensitometric Speed Evaluation of Layered Dyes in Example 1.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | |
|---|---|---|---|---|---|---|---|---|---|---|---|
| 1-1 | I-1 | 1.3 | — | — | 268 | 273 | 05 | 100 | 100 | 0 | Comparison |
| 1-2 | I-1 | 1.7 | — | — | 268 | 274 | 06 | 102 | 105 | 40 | Comparison |
| 1-3 | I-1 | 1.3 | II-2 | 1.3 | 246 | 258 | 12 | 132 | 135 | 91 | Invention |
| 1-4 | I-1 | 1.7 | II-2 | 1.3 | 235 | 254 | 19 | 155 | 151 | 108 | Invention |
| I-5 | I-2 | 1.3 | — | — | 289 | 293 | 04 | 100 | 100 | 0 | Comparison |
| I-6 | I-2 | 1.3 | II-2 | 1.3 | 256 | 266 | 10 | 115 | 148 | 31 | Invention |
| I-7 | I-3 | 1.3 | — | — | 265 | 268 | −03 | 100 | 100 | 0 | Comparison |
| I-8 | I-3 | 1.3 | II-2 | 1.3 | 254 | 263 | 09 | 115 | 138 | 39 | Invention |
| I-9 | I-4 | 1.3 | — | — | 256 | 260 | 04 | 100 | 100 | 0 | Comparison |
| I-10 | I-4 | 1.3 | II-2 | 1.3 | 225 | 241 | 16 | 132 | 148 | 67 | Invention |

[a]mmol/Ag mol.
[b]speed (reported in 100 × logE units) from a 365 line exposure measured at a density of 0.15 above Dmin.
[c]speed from an exposure that simulates daylight measured at a density of 0.15 above Dmin.
[d]the daylight speed of the sample minus the 365 line speed of the sample - this corrects for minor differences in the chemical sensitization and gives a better measure of dye performance.
[e]based on the daylight speed of the sample minus the 365 line speed of the sample and normalized relative to the comparison dye.

EXAMPLE 2

Photographic Evaluation

Film coating evaluations were carried out in color format on a sulfur-and-gold sensitized 0.2 μm cubic silver bromide emulsion containing iodide (2.5 mol %). The emulsion (0.0143 mole Ag) was heated to 40° C. The first sensitizing dye (see Table III for dye level) was added at and then the melt was heated to 60° C. for 15'. After cooling to 40° C., gelatin (647 g/Ag mole total) was added and then the second dye (see Table III for dye level), when present, was added to the melts after the finish cycle, but prior to dilution of the melts. Coating, exposure and processing, were carried out as described for Photographic Example 1. Results are shown in the Table III.

TABLE III

Sensitometric Speed Evaluation of Layered Dyes in Example 2.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | |
|---|---|---|---|---|---|---|---|---|---|---|---|
| 2-1 | I-1 | 1.4 | — | — | 265 | 271 | 06 | 100 | 100 | 0 | Comparison |
| 2-2 | I-1 | 1.4 | II-2 | 1.4 | 241 | 258 | 17 | 129 | 138 | 76 | Invention |
| 2-3 | I-1 | 1.4 | II-5 | 1.4 | 223 | 238 | 15 | 123 | 141 | 56 | Invention |
| 2-4 | I-1 | 1.7 | — | — | 263 | 269 | 06 | 100 | 100 | 0 | Comparison |
| 2-5 | I-1 | 1.7 | II-2 | 1.4 | 237 | 256 | 19 | 135 | 145 | 78 | Invention |
| 2-6 | I-1 | 1.7 | II-5 | 1.4 | 222 | 235 | 13 | 117 | 138 | 45 | Invention |

[a]mmol/Ag mol.
[b]speed (reported in 100 × logE units) from a 365 line exposure measured at a density of 0.15 above Dmin.
[c]speed from an exposure that simulates daylight measured at a density of 0.15 above Dmin.
[d]the daylight speed of the sample minus the 365 line speed of the sample - this corrects for minor differences in the chemical sensitization and gives a better measure of dye performance.
[e]based on the daylight speed of the sample minus the 365 line speed of the sample and normalized relative to the comparison dye.

EXAMPLE 3

Photographic Evaluation

Film coating evaluations were carried out in color format on a sulfur-and-gold sensitized 0.2 μm cubic silver bromide emulsion containing iodide (2.5 mol %). The emulsion (0.0143 mole Ag) was heated to 40° C. The first sensitizing dye (see Table IV for dye level) was added and then the melt was heated to 60° C. for 15'. After cooling to 40° C., gelatin (647 g/Ag mole total) was added and then the second dye (see Table IV for dye level), when present, was added to the melts after the finish cycle, but prior to dilution of the melts. Coating, exposure and processing, were carried out as described for Photographic Example 1. Results are shown in the Table IV.

Dye D-1

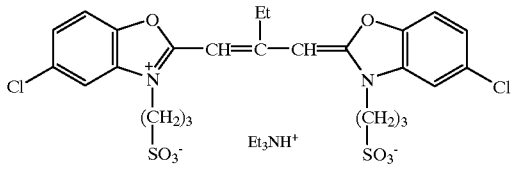

Dye D-2

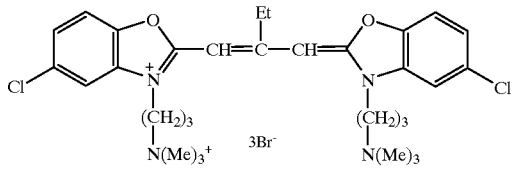

(carboxymethyl-trimethyl-2-thiourea, sodium salt, 2.3 mg/Ag mole) and an antifoggant (3-(3-((methylsulfonyl) amino)-3-oxopropyl)-benzothiazolium tetrafluoroborate), 37 mg/Ag mole) were added at 5' intervals, the melt was held for 20' and then heated to 60° C. for 20'. After cooling to 40° C. the second dye (see Table V for dye and level), when present, and in some cases a third dye (see Table V for dye and level), when present, was added to the melt. After 30' at 40° C., gelatin (647 mg/Ag mole total), distilled water (sufficient to bring the final concentration to 0.11 Ag mmole/g of melt) and tetrazaindine (1.0 g/Ag mole) were added.

Single-layer coatings were made on acetate support. Silver laydown was 0.5 g/m$^2$ (50 mg/ft$^2$). The emulsion was combined with a coupler dispersion containing N-[2-chloro-5-[(hexadecylsulfonyl)amino]phenyl]-2-[4-[4-hydroxyphenyl)sulfonyl]phenoxy]-4,4-dimethyl-3-oxopentanamide just prior to coating. Total gelatin laydown was 3.2 g/m$^2$ (300 mg/ft$^2$).

Sensitometric exposures (0.01 sec) were done using 365 nm Hg-line exposure or tungsten exposure with filtration to stimulate a daylight exposure. The described elements were processed for 3.25' in the known C-41 color process as described in Brit. J. Photog. Annual of 1988, p191–198 with the exception that the composition of the bleach solution was changed to comprise propylenediaminetetraacetic acid. Results are shown in the Table V.

TABLE IV

Sensitometric Speed Evaluation of Layered Dyes in Example 3.

| Example | First Dye | First Dye Level[a] | Second Dye | Second Dye Level[a] | 365L[b] | DL[c] | (DL-365L)[d] | Normalized Relative Sensitivity[e] | Normalized Relative Absorption | Layering Efficiency | |
|---|---|---|---|---|---|---|---|---|---|---|---|
| 3-1 | I-1 | 1.4 | — | — | 246 | 250 | 04 | 100 | 100 | 0 | Comparison |
| 3-2 | I-1 | 1.4 | II-7 | 1.4 | 241 | 255 | 14 | 126 | 138 | 68 | Invention |
| 3-3 | I-1 | 1.4 | II-3 | 1.4 | 228 | 236 | 08 | 110 | 129 | 34 | Invention |
| 3-4 | I-1 | 1.4 | II-4 | 1.4 | 235 | 243 | 08 | 110 | 141 | 24 | Invention |
| 3-5 | I-1 | 1.4 | II-6 | 1.4 | 211 | 228 | 17 | 135 | 145 | 78 | Invention |
| 3-6 | D-1 | 1.5 | — | — | 292 | 287 | −05 | 100 | 100 | 0 | Comparison |
| 3-7 | D-1 | 1.5 | D-2 | 1.4 | 280 | 277 | −03 | 95 | 158 | −09 | Comparison |

[a]mmol/Ag mol.
[b]speed (reported in 100 × logE units) from a 365 line exposure measured at a density of 0.15 above Dmin.
[c]speed from an exposure that simulates daylight measured at a density of 0.15 above Dmin.
[d]the daylight speed of the sample minus the 365 line speed of the sample - this corrects for minor differences in the chemical sensitization and gives a better measure of dye performance.
[e]based on the daylight speed of the sample minus the 365 line speed of the sample and normalized relative to the comparison dye.

EXAMPLE 4

Photographic Evaluation

Film coating evaluations were carried out in color format on a sulfur-and-gold sensitized 3.7 μm×0.11 μm silver bromide tabular emulsion containing iodide (3.6 mol %). Details of the precipitation of this emulsion can be found in Fenton, et al., U.S. Pat. No. 5,476,760. Briefly, 3.6% KI was run after precipitation of 70% of the total silver, followed by a silver over-run to complete the precipitation. The emulsion contained 50 molar ppm of tetrapotassium hexacyanoruthenate ($K_4Ru(CN)_6$) added between 66 and 67% of the silver precipitation. The emulsion (0.0143 mole Ag) was heated to 40° C. and sodium thiocyanate (100 mg/Ag mole) was added and after a 20' hold the first sensitizing dye (see Table V for dye and level) was added. After an additional 20' a gold salt (bis(1,3,5-trimethyl-1,2,4-triazolium-3-thiolate) gold(I) tetrafluoroborate, 2.4 mg/Ag mole), sulfur agent (N-

TABLE V

Sensitometric Speed Evaluation of Layered Dyes in Example 4.

| Example | First Dye | First Dye Level[a] | Second Dye | Second Dye Level[a] | Third Dye | Third Dye Level[a] | 365L[b] | DL[c] | (DL-365L)[d] | Normalized Relative Sensitivity[e] | Normalized Relative Absorption | Layering Efficiency | |
|---|---|---|---|---|---|---|---|---|---|---|---|---|---|
| 4-1 | I-6 | 1.0 | — | — | — | — | 287 | 267 | −20 | 100 | 100 | 0 | Comparison |
| 4-2 | I-6 | 1.0 | II-9 | 1.0 | — | — | 278 | 262 | −16 | 110 | 115 | 67 | Invention |
| 4-3 | I-6 | 1.0 | II-9 | 1.0 | I-6 | 0.5 | 270 | 256 | −14 | 115 | 129 | 52 | Invention |
| 4-4 | I-6 | 1.0 | II-8 | 1.0 | — | — | 282 | 269 | −13 | 117 | 120 | 85 | Invention |
| 4-5 | I-6 | 1.0 | II-8 | 1.0 | I-6 | 0.5 | 268 | 257 | −11 | 123 | 126 | 88 | Invention |

[a]mmol/Ag mol.
[b]speed (reported in 100 × logE units) from a 365 line exposure measured at a density of 0.15 above Dmin.
[c]speed from an exposure that simulates daylight measured at a density of 0.15 above Dmin.
[d]the daylight speed of the sample minus the 365 line speed of the sample - this corrects for minor differences in the chemical sensitization and gives a better measure of dye performance.
[e]based on the daylight speed of the sample minus the 365 line speed of the sample and normalized relative to the comparison dye.

EXAMPLE 5

Photographic Evaluation

Film coating evaluations were carried out in color format on a sulfur-and-gold sensitized 3.7 μm×0.11 μm silver bromide tabular emulsion containing iodide (3.6 mol %). Details of the precipitation of this emulsion can be found in Fenton, et al., U.S. Pat. No. 5,476,760. Briefly, 3.6% KI was run after precipitation of 70% of the total silver, followed by a silver over-run to complete the precipitation. The emulsion contained 50 molar ppm of tetrapotassium hexacyanoruthenate ($K_4Ru(CN)_6$) added between 66 and 67% of the silver precipitation. The emulsion (0.0143 mole Ag) was heated to 40° C. and sodium thiocyanate (120 mg/Ag mole) was added and after a 20' hold the first sensitizing dye (see Table VI for dye and level) was added. After another 20' the second sensitizing dye (see Table VI for dye and level) was added. After an additional 20' a gold salt (bis(1,3,5-trimethyl-1,2,4-triazolium-3-thiolate) gold(I) tetrafluoroborate, 2.2 mg/Ag mole), sulfur agent (N-(carboxymethyl-trimethyl-2-thiourea, sodium salt, 2.3 mg/Ag mole) and an antifoggant (3-(3-((methylsulfonyl)amino)-3-oxopropyl)-benzothiazolium tetrafluoroborate), 45 mg/Ag mole) were added at 5' intervals, the melt was held for 20' and then heated to 60° C. for 20'. After cooling to 40° C. 1-(3-acetamidophenyl)-5-mercaptotetrazole (75 mg/Ag mole) was added and then the third dye (see Table VI for dye and level) and then a fourth dye (see Table VI for dye and level) was added to the melt. After 30' at 40° C., gelatin (647 g/Ag mole total), distilled water (sufficient to bring the final concentration to 0.11 Ag mmole/g of melt) and tetrazaindine (1.0 g/Ag mole) were added.

Single-layer coatings were made on acetate support. Total gelatin laydown was 4.8 g/m$^2$ (450 mg/ft$^2$). Silver laydown was 0.5 g/m$^2$ (50 mg/ft$^2$). For samples 5-1, 5-2, and 5-3 the emulsion was combined with a coupler dispersion containing coupler C-1 just prior to coating. This is a cyan dye forming coupler and would normally be used in an emulsion layer with a red sensitizing dye. To facilitate analysis in a single layer coating, green sensitizing dyes were also being coated with this coupler. It is understood, however, that for traditional photographic applications the green sensitizing dyes of this invention would be used in combination with a magenta dye forming coupler. For samples 5-4 and 5-5 the emulsion was combined with a coupler dispersion containing magenta coupler C-2 just prior to coating.

C-1

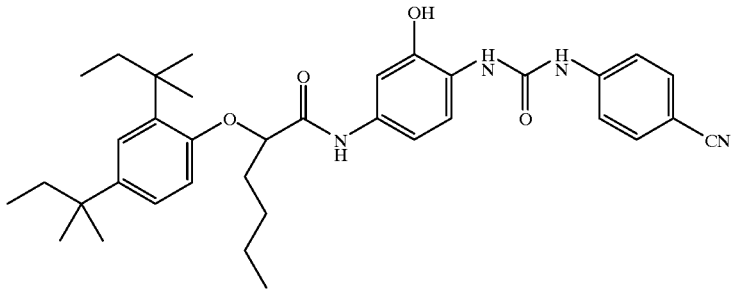

-continued

C-2

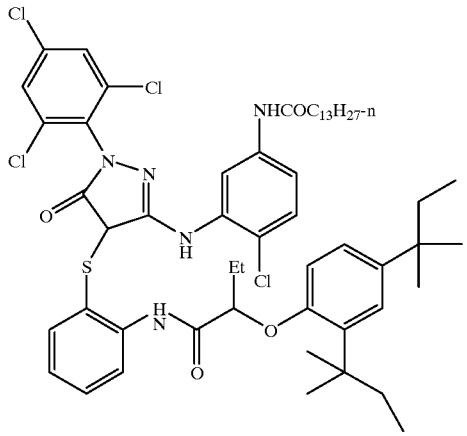

Sensitometric exposures (0.01 sec) were done using 365 nm Hg-line exposure or tungsten exposure with filtration to simulate a green light exposure. The described elements were processed for 3.25' in the known C-41 color process as described in Brit. J. Photog. Annual of 1988, p191–198 with the exception that the composition of the bleach solution was changed to comprise propylenediaminetetraacetic acid. Results are shown in the Table VI.

TABLE VI

Sensitometric Speed Evaluation of Layered Dyes in Example 5.

| Example | First Dye | First Dye Level[a] | Second Dye | Second Dye Level[a] | Third Dye | Third Dye Level[a] | Fourth Dye | Fourth Dye Level[a] | 365L[b] | DL[c] | (DL-365L)[d] | Normalized Relative Sensitivity[e] | Normalized Relative Absorption | Layering Efficiency | |
|---|---|---|---|---|---|---|---|---|---|---|---|---|---|---|---|
| 5-1 | I-6 | 0.76 | I-7 | 0.17 | — | — | — | — | 285 | 298 | 13 | 100 | 100 | 0 | Comparison |
| 5-2 | I-6 | 0.76 | I-7 | 0.17 | II-2 | 0.76 | I-1 | 0.38 | 282 | 314 | 32 | 155 | 162 | 89 | Invention |
| 5-3 | I-6 | 0.76 | I-7 | 0.17 | II-2 | 0.62 | I-1 | 0.62 | 282 | 316 | 34 | 162 | 182 | 76 | Invention |
| 5-5 | I-6 | 0.76 | I-7 | 0.17 | — | — | — | — | 311 | 319 | 08 | 100 | 100 | 0 | Comparison |
| 5-6 | I-6 | 0.76 | I-7 | 0.17 | II-2 | 0.76 | I-1 | 0.38 | 305 | 331 | 26 | 151 | 166 | 77 | Invention |

[a]mmol/Ag mol.
[b]speed (reported in 100 × logE units) from a 365 line exposure measured at a density of 0.15 above Dmin.
[c]speed measured at a density of 0.15 above Dmin from an exposure that simulates daylight exposure filtered to remove the blue light component.
[d]the speed of the sample minus the 365 line speed of the sample - this corrects for minor differences in the chemical sensitization and gives a better measure of dye performance.
[e]based on the speed of the sample minus the 365 line speed of the sample and normalized relative to the comparison dye.

EXAMPLE 6

Photographic Evaluation

Film coating evaluations were carried out on a sulfur-and-gold sensitized 3.9 $\mu$m×0. 11 $\mu$m silver bromide tabular emulsion containing 3.6 mol % iodide as described in example 4. Single-layer coatings were made on acetate support. Total gelatin laydown was 4.8 g/m$^2$. Silver laydown was 0.5 g/m$^2$. The emulsion was combined with a coupler dispersion containing coupler C-1 just prior to coating. Exposure and processing was carried out as described for Photographic Example 1. Results are shown in the Table VII.

TABLE VII

Sensitometric Speed Evaluation of Layered Dyes in Example 6.

| Example | First Dye | First Dye Level[a] | Second Dye | Second Dye Level[a] | Third Dye | Third Dye Level[a] | 365L[b] | DL[c] | (DL-365L)[d] | Normalized Relative Sensitivity[e] | Normalized Relative Absorption | Layering Efficiency | |
|---|---|---|---|---|---|---|---|---|---|---|---|---|---|
| 6-1 | I-6 | 1.0 | — | — | — | — | 285 | 268 | −17 | 100 | 100 | 0 | Comparison |
| 6-2 | I-6 | 1.0 | II-13 | 1.25 | — | — | 258 | 248 | −10 | 117 | 138 | 45 | Invention |
| 6-3 | I-6 | 1.0 | II-13 | 1.25 | I-6 | 0.5 | 248 | 241 | −07 | 126 | 166 | 39 | Invention |
| 6-4 | I-6 | 1.0 | II-10 | 1.25 | — | — | 268 | 255 | −13 | 110 | 132 | 31 | Invention |
| 6-5 | I-6 | 1.0 | II-10 | 1.25 | I-6 | 0.5 | 261 | 250 | −11 | 115 | 148 | 31 | Invention |
| 6-6 | I-6 | 1.0 | II-11 | 1.25 | — | — | 220 | 217 | −03 | 138 | 158 | 66 | Invention |
| 6-7 | I-6 | 1.0 | II-11 | 1.25 | I-6 | 0.5 | 231 | 232 | 01 | 151 | 178 | 65 | Invention |

[a]mmol/Ag mol.
[b]speed (reported in 100 × logE units) from a 365 line exposure measured at a density of 0.15 above Dmin.
[c]speed from an exposure that simulates daylight measured at a density of 0.15 above Dmin.
[d]the daylight speed of the sample minus the 365 line speed of the sample - this corrects for minor differences in the chemical sensitization and gives a better measure of dye performance.
[e]based on the daylight speed of the sample minus the 365 line speed of the sample and normaiized relative to the comparison dye.

It can be seen from photographic examples 1–6 that increasing the level of the primary dye (e.g., Table II, 1-2 vs. 1-1) does not increase the relative speed. However, the dye combinations of the invention give S enhanced spectral speed in a color format relative to the comparisons. It can be seen by from Examples 3-6 and 3-7 that when the dye layers are not held together by more then one non-covalent force than poor layering efficiency is obtained.

The invention has been described in detail with particular reference to certain preferred embodiments thereof, but it will be understood that variations and modifications can be effected within the spirit and scope of the invention.

What is claimed is:

1. A silver halide color photographic material comprising at least one silver halide emulsion comprising silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one cyanine dye, Dye 2, wherein one of Dye 1 or Dye 2 has at least one anionic substituent and one of Dye 1 or Dye 2 has at least one cationic substituent and wherein the dye layers are held together by more than one non-covalent force; the outer dye layer adsorbs light at equal or higher energy than the inner dye layer; and the energy emission wavelength of the outer dye layer overlaps with the energy absorption wavelength of the inner dye layer, said emulsion further comprising a color coupler.

2. A silver halide color photographic material according to claim 1, wherein Dye 1 and Dye 2 each have at least one aromatic substituent.

3. A silver halide color photographic material according to claim 1, wherein at least one of Dye 1 or Dye 2 has a hydrogen acceptor substituent and the other of Dye 1 or Dye 2 has a hydrogen donor substituent.

4. A silver halide color photographic material according to claim 1, wherein the following relationship is met:

$$E=100\Delta S/\Delta N_a \geqq 10 \text{ and } \Delta N_a \geqq 10$$

wherein

E is the layering efficiency;

ΔS is the difference between the Normalized Relative Sensitivity (S) of an emulsion sensitized with the inner dye layer and the Normalized Relative Absorption of an emulsion sensitized with both the inner dye layer and the outer dye layer; and $\Delta N_a$ is the difference between the Normalized Relative Absorption ($N_a$) of an emulsion sensitized with the inner dye layer and the Normalized Relative Absorption of an emulsion sensitized with both the inner dye layer and the outer dye layer.

5. A color photographic material according to claim 1, comprising (a) an inner dye layer adjacent to the silver halide grain and comprising at least one dye, Dye 1, that is a cyanine dye capable of spectrally sensitizing silver halide and (b) an outer dye layer adjacent to the inner dye layer and comprising at least two cyanine dyes, Dye 2, and Dye 3, wherein Dye 1 and Dye 3 each have at least one anionic substituent and Dye 2 has at least one cationic substituent.

6. A silver halide color photographic material according to claim 5 wherein Dye 2 forms a liquid-crystalline phase in aqueous gelatin at a concentration of 1 weight percent or less and Dye 3 forms a liquid-crystalline phase in aqueous gelatin at a concentration of 1 weight percent or less.

7. A silver halide color photographic material according to claim 6 wherein Dye 2 forms a J-aggregate in aqueous gelatin at a concentration of 1 weight percent or less and Dye 3 forms a J-aggregate in aqueous gelatin at a concentration of 1 weight percent or less.

8. A silver halide color photographic material according to claim 1, wherein the dye or dyes of the outer dye layer aggregate in aqueous gelatin at a concentration of 1 weight percent or less.

9. A silver halide color photographic material according to claim 1, wherein a compound containing a mercapto group or a thiocarbonyl group is added after the first layer of dye is formed and before any subsequent dye layer is formed.

10. A silver halide color photographic material according to claim 1, wherein a compound of Formula A is added after the first layer of dye is formed and before any subsequent dye layer is formed,

A

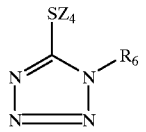

wherein $R_6$ represents a substituted or unsubstituted alkyl group, alkenyl group or aryl group and $Z_4$ represents a hydrogen atom, an alkali metal atom, an ammonium group or a protecting group that can be removed under alkaline or acidic conditions.

11. A silver halide color photographic material according to claim 1, wherein Dye 1 is of Formula I and Dye 2 is of Formula II, (I)

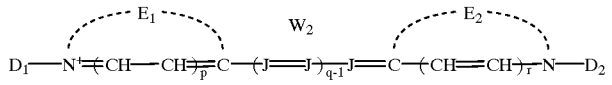

wherein:

$E_1$ and $E_2$ may be the same or different and represent the atoms necessary to form a substituted or unsubstituted heterocyclic ring which is a basic nucleus, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aIyl and at least one of $D_1$ and $D_2$ contains an anionic substituent, $W_2$ is one or more a counter ions as necessary to balance the charge;

(II)

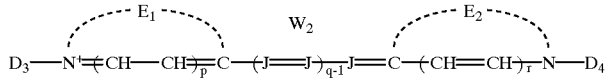

wherein:

$E_1$, $E_2$, J, p, q and $W_2$ are as defined above for Formula (I), $D_3$ and $D_4$ each independently represents substituted or unsubstituted alkyl or unsubstituted aryl and $D_3$ and $D_4$ do not contain an anionic substituent and at least one of $E_1$, $E_2$, J or $D_3$ and $D_4$ contains a cationic substituent, if $D_3$ and $D_4$ contains an aromatic or heteroaromatic group then $D_1$ and D2 do not contain an aromatic or heteroaromatic group.

12. A color photographic material according to claim 11, wherein the dye of formula I is of formula Ib and the dye of formula II is of formula IIb, Ib

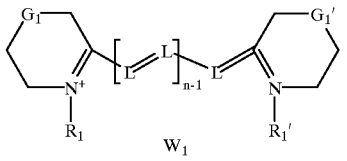

IIb

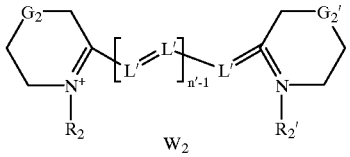

wherein:

$G_1$ and G1' independently represent the atoms necessary to complete a benzothiazole nucleus, benzoxazole nucleus, benzoselenazole nucleus, benzotellurazole nucleus, quinoline nucleus, or benzimidazole nucleus in which $G_1$ and $G_1$' independently may be substituted or unsubstituted and preferably either $G_1$ or $G_1$" contains at least one aromatic or heteroaromatic subsitutent;

$G_2$ and $G_2$' independently represent the atoms necessary to complete a benzothiazole nucleus, benzoxazole nucleus, benzoselenazole nucleus, benzotellurazole nucleus, quinoline nucleus, indole nucleus, or benzimidazole nucleus in which $G_2$, and $G_2$' independently may be substituted or unsubstituted and preferably either $G_1$ or $G_1$" contains at least one aromatic or heteroaromatic subsitutent;

n and n' are independently a positive integer from 1 to 4, each L independently represents a substituted or unsubstituted methine group, $R_1$ and $R_1$' each independently represents substituted or unsubstituted aryl or substituted or unsubstituted aliphatic group, at least one of $R_1$ and $R_1$' has a negative charge, $W_1$ is a cationic counter ion to balance the charge if necessary, $R_2$ and $R_2$' each independently represents substituted or unsubstituted aryl or substituted or unsubstituted aliphatic group and at least one of $R_2$ and $R_2$' has a positive charge; such that the net charge of IIb is +1, +2, +3 , +4, or +5, $W_2$ is one or more anionic counterions to balance the charge.

13. A color photographic material according to claim 12, wherein both $R_3$ an $R_4$ contain a quaternary ammonium group.

14. A color photographic material according to claim 11, wherein Dye 1 is of Formula Ic and Dye 2 is of Formula IIc:

Ic

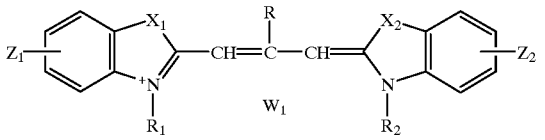

wherein:

$X_1$ and $X_2$, independently represent S, Se, O, or N—R' (where R' is substituted or unsubstituted alkyl or substituted or unsubstituted aryl) with the proviso that at least one of $X_1$ and $X_2$ is, O;

$Z_1$ and $Z_2$, each contain independently at least one substituted or unsubstituted aromatic or heteroaromatic group;

R is hydrogen, substituted or unsubstituted lower alkyl, substituted or unsubstituted aryl, or substituted or unsubstituted alkylaryl;

$R_1$ and $R_2$ each independently represents substituted or unsubstituted aryl or substituted or unsubstituted aliphatic group, with the proviso that at least one of $R_1$ and $R_2$ has a negative charge; and $W_1$ is a cationic counterion if needed to balance the charge.

IIc

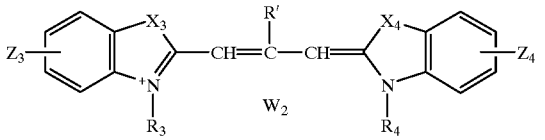

wherein:

$X_3$ and $X_4$ independently represent S, Se, O or N—R', (where R' is substituted or unsubstituted alkyl or substituted or unsubstituted aryl), with the proviso that at least one of at least one of $X_3$ and $X_4$ is O, $Z_3$ and $Z_4$ each independently contain at least one substituted or unsubstituted aromatic group;

R' is hydrogen, substituted or unsubstituted lower alkyl, substituted or unsubstituted aryl or substituted or unsubstituted alkylaryl;

$R_3$ and $R_4$ each independently represents substituted or unsubstituted aryl or substituted or unsubstituted aliphatic group, with the proviso that $R_3$ and $R_4$ have a net charge of zero or greater; and $W_2$ is a anionic counterion to balance the charge if necessary.

15. A color photographic material according to claim 14, wherein both X3 and X4 are O.

16. A color photographic material according to claim 15, wherein R and R' are ethyl groups and both $Z_3$ and $Z_4$ are independently substituted or unsubstituted aromatic groups and $R_1$, $R_2$, $R_3$, and $R_4$ are substituted or unsubstituted aliphatic groups and at least one of $R_3$ and $R_4$ contains a quaternary ammonium group.

17. A silver halide color photographic material comprising at least one silver halide emulsion layer comprising silver halide grains having associated therewith at least one dye which contains an anionic substituent and at least one dye that has a cationic substituent, wherein the emulsion layer further comprises an image dye forming coupler.

18. A color photographic material according to claim 17, wherein said emulsion layer further comprises a dispersion of an image dye forming coupler and an anionic surfactant in an organic solvent.

19. A color photographic material according to claim 18, comprising a dye having at least two cationic substitutents.

20. A color photographic material according to claim 17 wherein at least one of said dyes forms a liquid-crystalline phase in aqueous gelatin at a concentration of 1 weight percent or less.

21. A color photographic material according to claim 17, wherein at least one of said dyes i s a cyanine dye.

22. A color photographic material according to claim 17, wherein at least one of said dyes forms a J-aggregate.

* * * * *

UNITED STATES PATENT AND TRADEMARK OFFICE

CERTIFICATE OF CORRECTION

PATENT NO. : 6,165,703
DATED : December 26, 2000
INVENTOR(S) : Richard L. Parton et al.

It is certified that error appears in the above-identified patent and that said Letters Patent is hereby corrected as shown below:

Title page,
Lines 1 and 2, "[54] COLOR PHOTOGRAPHIC MATERIAL HAVING ENHANCED LIGHT ABSORPTION" change to -- [54] DYE LAYERING FOR ENHANCED LIGHT ABSORPTION --
In the ABSTRACT, last paragraph, line 4, "dyc" change to -- dye --

Claim 4,
Line 4, was missing, insert -- wherein E is the layering efficiency; --

Claims 5, 12, 13, 14, 15, 19, 20, 21 and 22,
Line 1, insert between "A" and "color", -- silver halide --

Claim 11,
Line 15, "countcr ions" change to -- counterions --

Claim 12,
Line 28, "countcr ion" change to -- counterion --

Signed and Sealed this

Eleventh Day of December, 2001

*Attest:*

Nicholas P. Godici

NICHOLAS P. GODICI
*Acting Director of the United States Patent and Trademark Office*

*Attesting Officer*